US007491880B2

(12) United States Patent
Hirota et al.

(10) Patent No.: US 7,491,880 B2
(45) Date of Patent: Feb. 17, 2009

(54) SOUND CONTROL APPARATUS FOR A KEYBOARD-BASED MUSICAL INSTRUMENT

(75) Inventors: Kenichi Hirota, Hamamatsu (JP); Tetsuya Hirano, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 11/780,394

(22) Filed: Jul. 19, 2007

(65) Prior Publication Data

US 2008/0017019 A1 Jan. 24, 2008

(30) Foreign Application Priority Data

Jul. 20, 2006 (JP) ..... 2006-198800

(51) Int. Cl.
*G10H 3/05* (2006.01)

(52) U.S. Cl. ..... 84/724; 84/21

(58) Field of Classification Search ..... 84/724, 84/171, 21

See application file for complete search history.

(56) References Cited

U.S. PATENT DOCUMENTS 4,736,662 A 4/1988 Yamamoto
4,913,026 A * 4/1990 Kaneko et al. ..... 84/21
5,012,715 A 5/1991 Matsunaga et al.
5,200,570 A 4/1993 Kawamura
5,254,804 A * 10/1993 Tamaki et al. ..... 84/626
5,583,310 A 12/1996 Sugiyama et al.
5,824,930 A * 10/1998 Ura et al. ..... 84/462

FOREIGN PATENT DOCUMENTS

JP 2-160292 6/1990

* cited by examiner

*Primary Examiner*—Jeffrey Donels
(74) *Attorney, Agent, or Firm*—Crowell & Moring LLP

(57) ABSTRACT

A sound control apparatus for a keyboard-based musical instrument for avoiding a touch of a shutter to a back check, thereby appropriately setting a sound generation timing and maintaining a satisfactory touch feeling. The sound control apparatus comprises a shutter integrated with a hammer adapted to swing associated with a swinging motion of a key, extending along a plane including a path along which said hammer swings, and formed with a cutout in an edge on an opposite side to a direction in which said hammer swings. An optical sensor has a light emitter disposed on one side of the swinging path of said shutter for emitting light, and a light receiver disposed on the other side of the swinging path for receiving the light from said light emitter, and generates a detection signal in accordance with a light receiving state of said light receiver. A CPU sets a sound generation timing at which music sound should be generated based on the detection signal of said optical sensor responsive to opening and closing of a light path of the light from said light emitter of said optical sensor by said shutter, when said hammer swings.

4 Claims, 13 Drawing Sheets

SOUND CONTROL APPARATUS FOR A KEYBOARD-BASED MUSICAL INSTRUMENT

BACKGROUND OF THE INVENTION

1. Field of the Invention

The present invention relates to a sound control apparatus for a keyboard-based musical instrument, which is applied to an electronic keyboard-based musical instrument such as an electronic piano and a composite piano such as a silent piano and an automatic playing piano for setting a sound generation timing.

2. Description of the Prior Art

A known conventional sound control apparatus for a keyboard-based musical instrument is disclosed, for example, in Laid-open Japanese Patent Application No. 2-160292. This sound control apparatus 61 is applied to an upright automatic playing piano, and as illustrated in FIG. 1, comprises a swingable key (not shown), a hammer 63 for pivotal movement about a center pin 68 in association with a touch on the key to strike a string 62, a shutter 64 attached to the hammer 63, a first and a second sensor 65, 66, and the like. The shutter 64 is formed in an arcuate shape which has one end fixed to a front surface of a hammer shank 63*a*, and the other end fixed on a top surface of a catcher 63*b*, respectively. The shutter 64 is also formed with an arcuate shutter window 67 conformal thereto. This shutter window 67 comprises an upper half 67*a* and a lower half 67*b* which is offset toward the hammer shank 63*a*, i.e., the rear side with respect to the upper half 67*a*.

The first and second sensors 65, 66 are arranged adjacent to each other at positions corresponding to the upper half 67*a* and lower half 67*b* of the shutter window 67. Each of the sensors 65, 66 comprises one set of a light emitter and a light receiver (none of which is shown) disposed on one and the other sides of the shutter 64.

With the foregoing configuration, light from the light emitter of the first sensor 65 is intercepted by the shutter 64, while light from the light emitter of the second sensor 66 reaches the light receiver through the lower half 67*b* of the shutter window 67 in a key released state indicated by solid lines in FIG. 1. From the key released state, the shutter 64 pivotally moves together with the hammer 63, to the accompaniment of pivotal movement of the hammer 63 in the counter-clockwise direction in FIG. 1, associated with a touch on the key. Associated with this pivotal movement, the rear end of the upper half 67*a* of the shutter window 67 through the shutter 64 reaches the first sensor 65, causing light to reach its light receiver. As the hammer 63 further pivotally moves, a leading edge of the lower half 67*b* of the shutter window 67 passes the second sensor 66, and intercepts light from the light emitter of the second sensor 66. As the hammer 63 further pivotally moves, the leading edge of the upper half 67*a* of the shutter window 67 passes the first sensor 65 immediately before the hammer 63 strikes the string 62, thereby intercepting the light from the light emitter of the first sensor 65. On the other hand, when the key is released, detection signals of the first and second sensors 65, 66 change in the order reverse to the foregoing.

In this sound control apparatus 61, a timing at which the detection signal of the second sensor 66 indicates a light path closed state and the detection signal of the first sensor 65 switches from an open state to a closed state is set and recorded as a sound generation timing at which sound should be generated in a automatic play. Also, a timing at which the detection signal of the second sensor 66 indicates an open state and the detection signal of the first sensor 65 switches from the open state to the closed state is set and recorded as a sound stop timing. After striking the string 62, the hammer 63 pivotally moves in the clockwise direction in FIG. 1, to return to its home position, and in the halfway, the catcher 63*b* abuts to a back check 69 implanted on a wippen (not shown) and stops.

However, in the conventional sound control apparatus 61, since the shutter 64 is attached to the catcher 63*b*, the shutter 64 tends to come into contact with the back check 69, making the hammer 63 more susceptible to rebound. As the hammer 63 rebounds in this way, the shutter 64 can close the light paths of the second sensor 66 and first sensor 65 in this order. In this event, the first and second sensors 65, 66 generate the same detection signals as those which are generated at the sound generation timing, resulting in erroneous generation of sound, though no key touch operation is actually performed.

In addition, the shutter 64 comes into contact with the back check 69 to cause vibrations which are transmitted to the key through an associated action, thus impairing a touch feeling. Further, since the sound stop timing is set in the manner described above, the shutter 64 must be attached such that it closes the light path of the first sensor 65 and opens the light path of the second sensor 66 in the key released state. Such assembling work requires much labor and time.

SUMMARY OF THE INVENTION

The present invention has been made to solve the problem as mentioned above, and it is an object of the invention to provide a sound control apparatus for a keyboard-based musical instrument which is capable of avoiding a touch of a shutter to a back check, thereby appropriately setting a sound generation timing and maintaining a satisfactory touch feeling.

To achieve the above object, the present invention provides a sound control apparatus for a keyboard-based musical instrument which is characterized by comprising a swingable key; a hammer adapted to swing associated with a swinging motion of the key; a plate-shaped shutter integrated with the hammer, extending along a plane including a swinging path along which the hammer swings, and formed with a cutout in an edge on an opposite side to a direction in which the hammer swings associated with a touch on the key; an optical sensor having a light emitter disposed on one side of the swinging path of the shutter for emitting light, and a light receiver disposed on the other side of the swinging path for receiving the light from the light emitter, for generating a detection signal in accordance with a light receiving state of the light receiver; and sound generation timing setting means for setting a sound generation timing at which music sound should be generated based on the detection signal of the optical sensor responsive to opening and closing of a light path of the light from the light emitter of the optical sensor by the shutter, when the hammer swings.

According to this sound control apparatus for a keyboard-based musical instrument, as the hammer swings associated with a swinging motion of the key, the plate-shaped shutter integrated with the hammer opens and closes the light path of light from the light emitter of the optical sensor, and the optical sensor generates a detection signal in accordance with a light receiving state of the light receiver which changes in response to the opened and closed light path. The sound generation timing setting means sets a sound generation timing at which music sound should be generated based on the detection signal of the optical sensor.

According to the present invention, the shutter is formed with the cutout in an edge on an opposite side to a direction in which the hammer swings associated with a touch on the key. Thus, even when one end of the shutter is attached, for example, to the catcher of the hammer in an upright piano, the shutter can be prevented from getting in touch with the back check by virtue of the existence of the cutout, when the hammer swings back toward the cutout, causing the catcher to come into contact with the back check. Accordingly, the sound generation timing can be appropriately set because of the ability to prevent the hammer from rebounding due to the shutter getting in touch with the back check, and erroneously generated sound caused thereby. Also, by preventing the shutter from getting in touch with the back check, it is possible to prevent vibrations associated therewith to maintain a satisfactory touch feeling, as a result.

Preferably, the sound control apparatus for a keyboard-based musical instrument described above further comprises sound stop timing setting means for setting a sound stop timing at which the music sound should be stopped based on the detection signal of the optical sensor, wherein the sound generation timing setting means sets the sound generation timing based on a timing at which the detection signal changes from a closed state to an opened state in response to the optical sensor being passed by the edge formed with the cutout of the shutter, and the sound stop timing setting means sets the sound stop timing based on a timing at which the detection signal changes from a closed state to an opened state in response to the optical sensor being passed by the edge of the shutter opposite to the edge formed with the cutout.

According to this preferred embodiment of the sound control apparatus for a keyboard-based musical instrument, as the hammer swings associated with a touch on the key, the shutter intercepts the light path of the optical sensor, causing the detection signal of the sensor to change to a closed state. Subsequently, as the hammer further swings, the edge of the shutter formed with the cutout passes the optical sensor to open the light path of the optical sensor, causing the detection signal to change from the closed state to an opened state. The sound generation timing setting means sets a sound generation timing based on the timing at which the detection signal changes.

Also, when the hammer swings back in the opposite direction to the foregoing after the sound generation timing has been set, the shutter intercepts the light path of the optical sensor, causing the detection signal to change to the closed state. Subsequently, as the hammer further swings back, the edge of the shutter opposite to the cutout passes the optical sensor to open the light path of the optical sensor, causing the detection signal to change from the closed state to the opened state. Then, the sound stp setting means sets a sound stop timing based on the timing at which the detection signal changes.

As described above, in the present invention, the sound generation timing can be set making use of the edge of the shutter formed with the cutout, and the sound stop timing can be set making use of the edge opposite to the cutout. Consequently, since the shutter need not be formed with a shutter window, like the conventional sound control apparatus, the shutter can be correspondingly simplified in shape. In addition, with the omission of the shutter window, the shutter need not be attached such that it closes a light path of a first optical sensor and opens a light path of a second optical sensor in the key released state, unlike the conventional sound control apparatus, so that the shutter can be readily assembled.

Preferably, in the sound control apparatus for a keyboard-based musical instrument described above, the optical sensor comprises a plurality of optical sensors disposed along the swinging path, and the sound control apparatus further comprises sound generation prohibiting means for prohibiting the sound generation timing setting means from setting a new sound generation timing until all detection signals of the plurality of optical sensors change to a closed state after setting the sound generation timing.

According to this preferred embodiment of the sound control apparatus for a keyboard-based musical instrument, the sound generation prohibiting means prohibits the sound generation timing setting means from setting a new sound generation timing until all detecting signals of the plurality of optical sensors disposed along the swinging path change to the closed state after setting the sound generation timing. Thus, supposing that the hammer swings in the opposite direction halfway during its swinging motion back to the retracted position, or that the hammer remains at a midway position, a new sound generation timing will not be set unless all the detection signals change to the closed state even if the edge of the shutter formed with the cutout has passed the optical sensors to cause the detection signals to change from the closed state to the opened state, thus making it possible to prevent erroneously generated sound due to such setting. Thus, for example, even when the key is touched with a large force, the catcher strongly hits the back check halfway in a swinging return motion of the hammer, causing the hammer to rebound, a sound generation timing can be prohibited from being set when the detection signal changes from the closed state to the opened state.

Also, the hammer may swing at a shifted timing or stop at a shifted position due to abrasion or the like, for example, in the back check over time, causing the edge of the shutter formed with the cutout to stay on the light path of the optical sensor to result in chattering of the detection signal. Even in such an event, erroneously generated sound can be prevented because a new sound generation timing is not set unless all detection signals go to the closed state, as described above. Further, during a return swinging motion of the hammer, the key can be again touched after the hammer has swung back to certain degree, repeated touches can be carried out. According to the present invention, since a new sound generation timing can be set when all the detection signals change to the closed state, the touch repetition performance can be ensured.

DETAILED DESCRIPTION OF THE PREFERRED EMBODIMENTS

Figure 1:
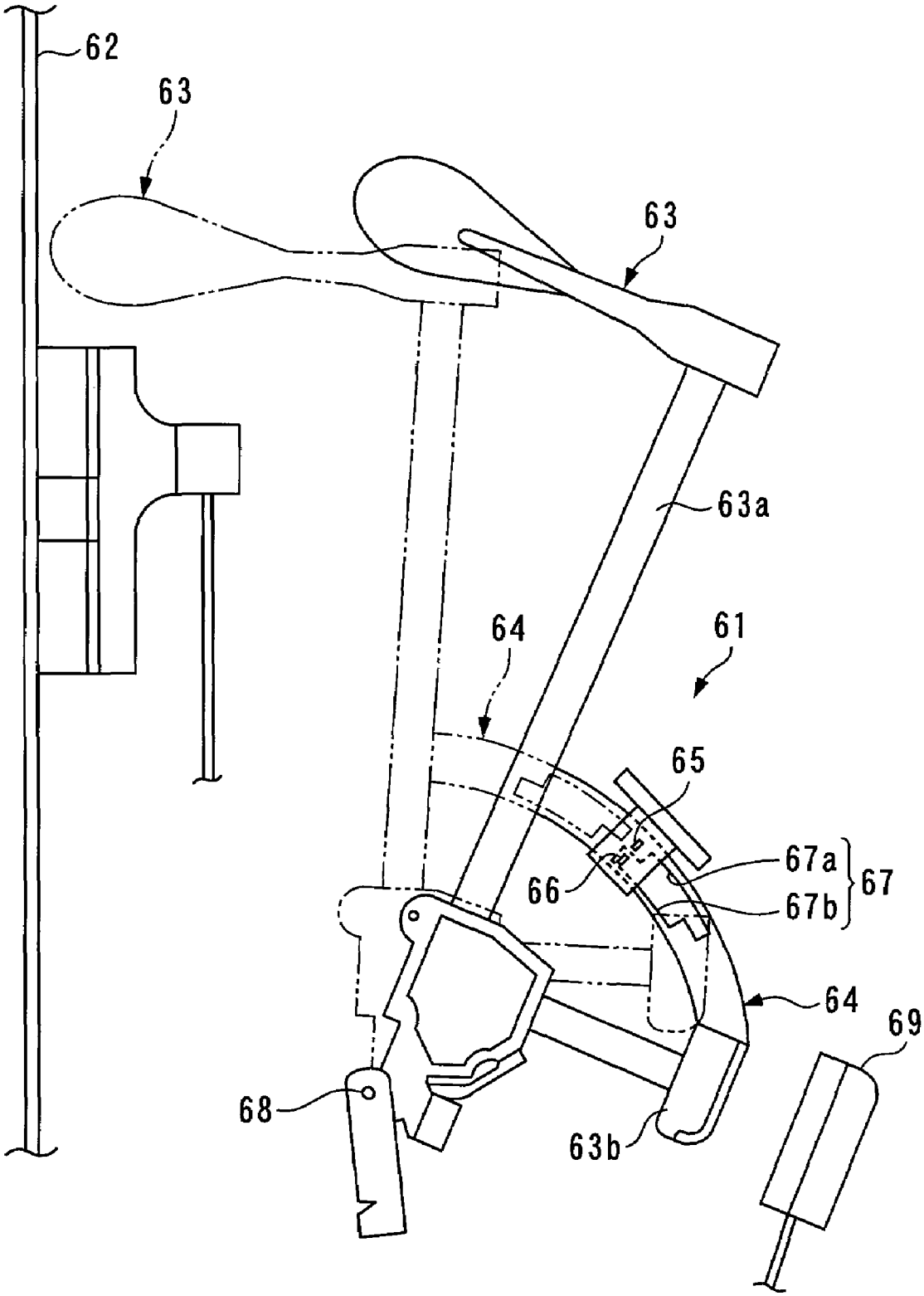
F I G. 1 PRIOR ART
FIG. 1 is a side view illustrating a conventional sound control apparatus.
Figure 2:
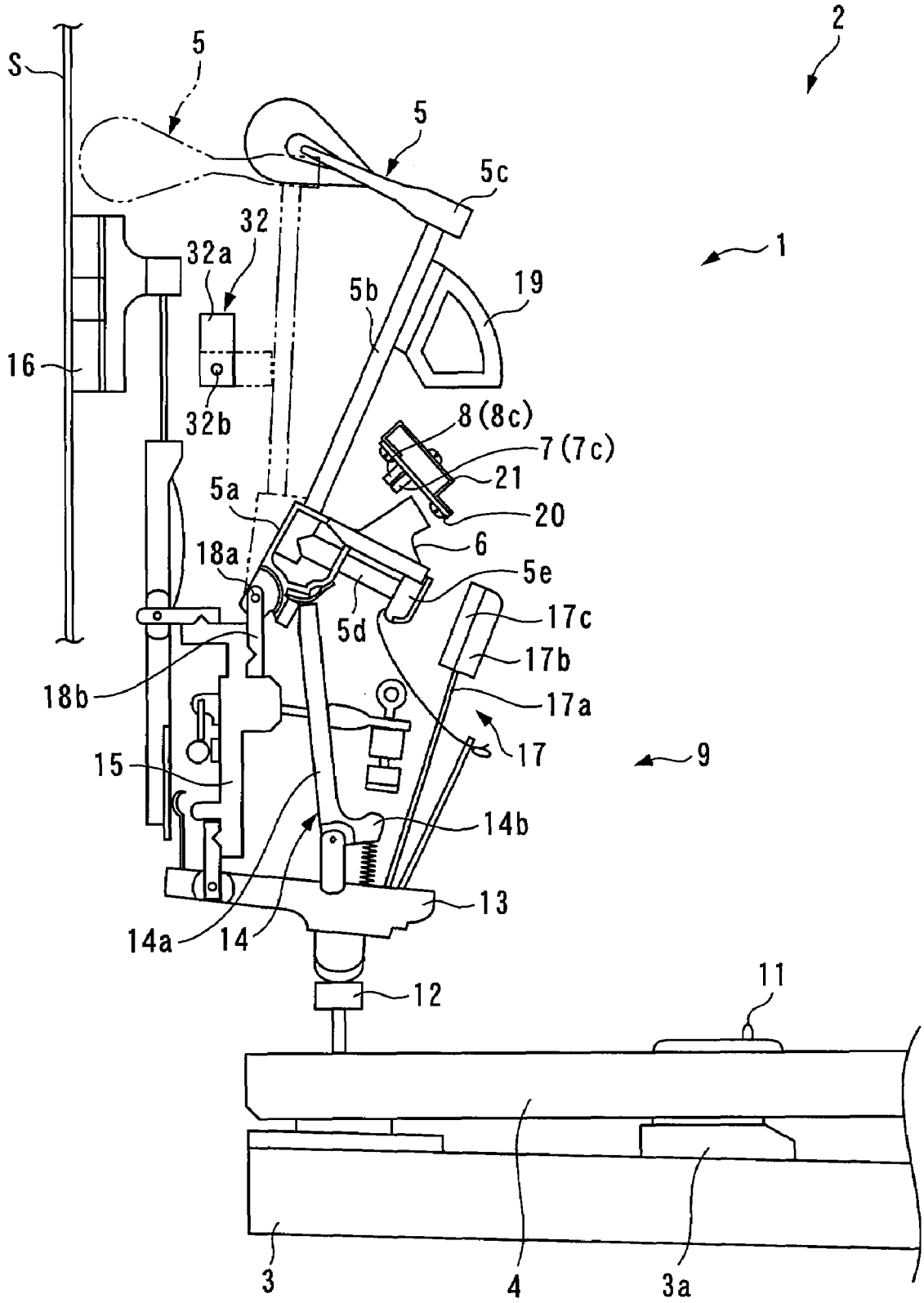
FIG. 2 is a diagram generally illustrating the configuration of a sound control apparatus according to one embodiment of the present invention and a silent piano to which the sound control apparatus is applied.

In the following, preferred embodiments of the present invention will be described in detail with reference to the accompanying drawings. FIG. 2 illustrates an upright silent piano 2 (keyboard-based musical instrument) to which a sound control apparatus 1 is applied in accordance with one embodiment of the present invention. In the following description, assume that, as viewed from a player side, the front side (right side in FIG. 2) of the silent piano 2 is called the "front," and the back side (left side in FIG. 2) of the same, the "rear."

As illustrated in FIG. 2, the silent piano 2 comprises a plurality (for example, 88) keys 4 (only one of which is shown) carried on a keybed 3, an action 9 disposed above the rear end of the keys 4, and a hammer 5 disposed for each key 4. The silent piano 2 also comprises a shutter 6 attached to the hammer 5, a first and a second optical sensor 7, 8, a sound generator 10 (see FIG. 8) for electronically generating play sound, and the like. The silent piano 2 can be switched between a normal play mode for generating acoustic play sound by striking a string S with the hammer 5, and a silent play mode for generating electronic play sound by the sound generator 10 while the hammer 5 is prevented from striking the string S.

The key 4 is swingably supported by a balance pin 11 implanted on a balance rail 3*a* disposed on the keybed 3 through a balance pin hole (not shown) formed at the center of the key 4.

The action 9, which is provided to pivotally move the hammer 5 in association with a touch on the key 4, comprises a wippen 13 which extends in the depth direction and is carried on a rear region of each key 4 through a capstan screw 12, a jack 14 attached to the wippen 13, and the like. Each wippen 13 is pivotably supported by a center rail 15 at a rear end thereof. The jack 14, which is formed in an L-shape, comprises a hammer push-up rod 14*a* extending upward, and a regulating button contact protrusion 14*b* extending in front substantially at right angles from a lower end of the hammer push-up rod 14*a*, and is pivotably attached to the wippen 13 at the corner between the regulating button contact protrusion 14*b* and the hammer push-up rod 14*a*. Further, a damper 16 is pivotably attached to a rear end of the center rail 15.

The wippen 13 comprises a back check 17 implanted thereon. The back check 17 comprises a back check wire 17*a* extending upward from a front end of the wippen 13, a back check body 17*b* attached to an upper end of the back check wire 17*a*, and a back check skin 17*c* attached to the back surface of the back check body 17*b*.

The hammer 5 in turn comprises a bat 5*a*, a hammer shank 5*b* extending upward from the bat 5*a*, a hammer head 5*c* attached to an upper end of the hammer shank 5*b*, a catcher shank 5*d* extending in front from the bat 5*a*, a catcher 5*e* attached to a front end of the catcher shank 5*d*, and the like. The hammer 5 is swingably supported by a bat flange 18 through a center pin 18*a* at a lower end of the bat 5*a*. In a key released state illustrated in FIG. 2, the bat 5*a* is in engagement with the leading end of the hammer push-up rod 14*a* of the jack 14, the hammer shank 5*b* is obliquely in contact with a hammer rail 19, and the hammer head 5*c* opposes the string S.

Figure 3A:
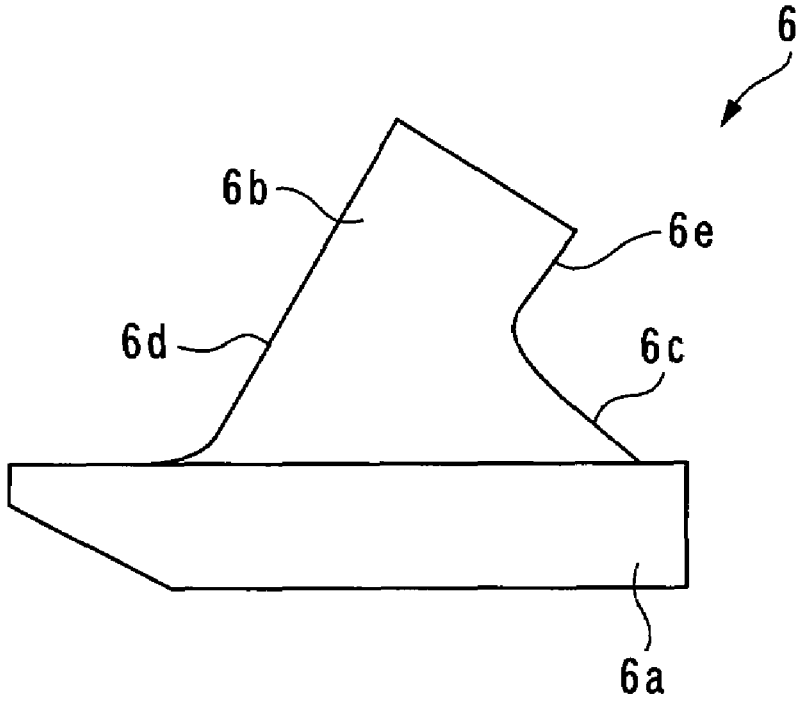
FIGS. 3A and 3B are a side view and a front view of a shutter, respectively.
Figure 3B:
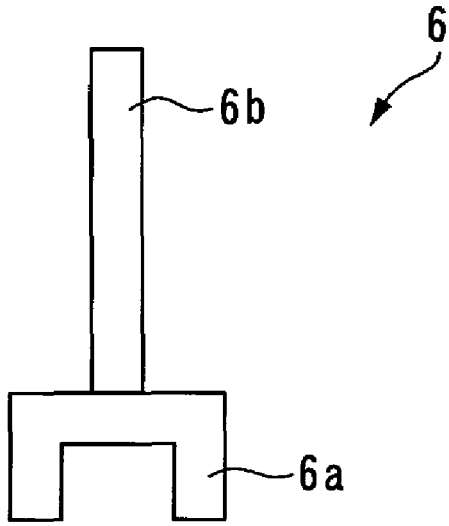
Figure 4:
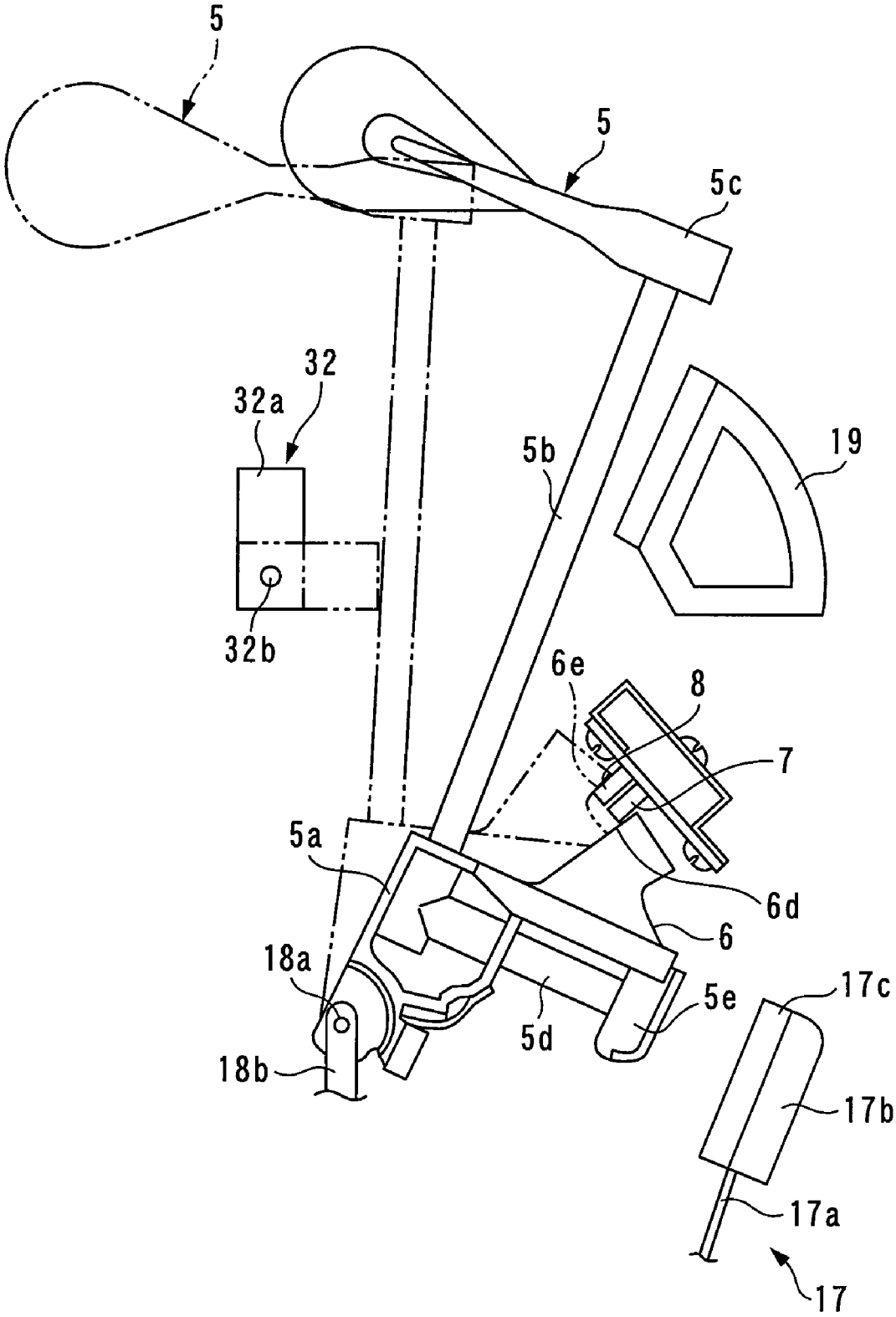
FIG. 4 is a partially enlarged view of FIG. 1.

The shutter 6 is made of an opaque material which does not transmit light, for example, synthetic resin. As illustrated in FIGS. 2 to 4, the shutter 6 comprises a mount 6*a* extending in the depth direction, and a plate-shaped body 6*b* extending upward from the mount 6*a*. The mount 6*a* has an inverted U-shaped cross section which has an inner width slightly smaller than the widths of the bat 5*a* and catcher 5*e*. The shatter 6 is attached to the hammer 5 by fitting a front end of the mount 6*a* into the catcher 5*e* and a rear end of the mount 6*a* into the bat 5*a*, respectively, from above. A rear edge (back surface) 6*d* of the body 6*b* obliquely extends upward in front in straight. A cutout 6*c* is formed into a front region of the body 6*b*. A front edge 6*e* of the body 6*b* facing the cutout 6*c* extends obliquely substantially in parallel with the rear edge 6*d*.

Figure 5:
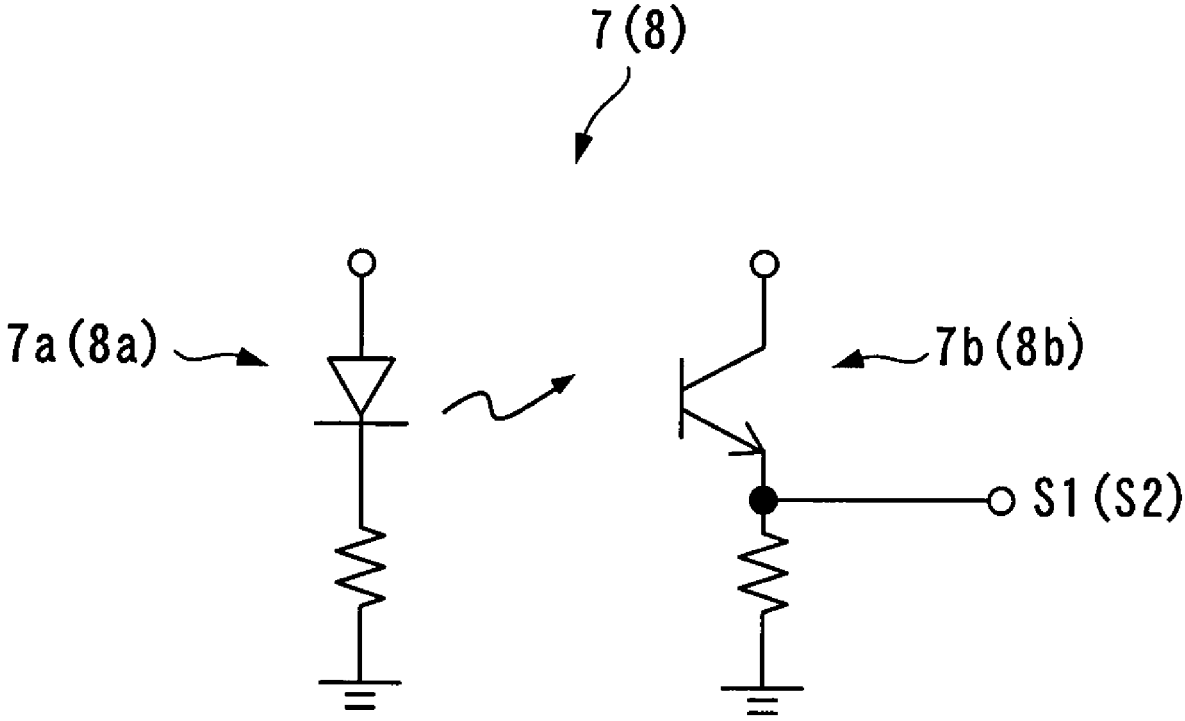
FIG. 5 is a circuit diagram of a first and a second sensor.

The first and second optical sensors 7, 8 comprise photo-interrupters in the same configuration as each other. As illustrated in FIGS. 2 and 5, the first optical sensor 7 comprises a case 7*c*, and a pair of a light emitting diode 7*a* (light emitter) and a photo-transistor 7*b* (light receiver) placed in the case 7*c* such that they oppose each other in the lateral direction. Likewise, the second optical sensor 8 comprises a pair of light emitting diode 8*a* (light emitter) and a photo-transistor 8*b* (light receiver) placed in a case 8*c* such that they oppose each other in the lateral direction. The first and second optical sensors 7, 8 are mounted on a circuit board 20, where the first sensor 7 is positioned on a lower side, while the second sensor 8 on an upper side, with respect to a swinging path along which the shutter 6 pivotally moves. The light emitting diodes 7*a*, 8*a* and photo-transistors 7*b*, 8*b* are disposed on one and the other sides of the swinging path of the shutter 6. The circuit board 20 extends in the lateral direction, and is attached to a attachment rail 21 extending between brackets (none of which is shown) attached at the left and right ends of the keybed 3.

Each of the light emitting diodes 7*a*, 8*a* comprises a pn-bonded diode which has its anode and cathode electrically connected to the circuit board 20, respectively. The light emitting diode 7*a*, 8*a* activates in response to a driving signal supplied to the anode from a CPU 23, later described, to emit light from its light emitting surface (not shown) toward the photo-transistor 7*b*, 8*b* along a horizontal light path.

Each of the photo-transistors 7*b*, 8*b* comprises an npn-bonded bipolar transistor which has its collector and emitter electrically connected to the circuit board 20, respectively. The photo-transistor 7*b*, 8*b* receives light on a light receiving surface (not shown) which is comparable to its base, and conducts between the collector and emitter when the amount of light (hereinafter called the "amount of received light") is equal to or larger than a predetermined level, to generate a signal at H level from the emitter. On the other hand, when the amount of received light is smaller than the predetermined level, the photo-transistor 7*b*, 8*b* does not conduct between the collector and emitter to generate a signal at L level from the emitter. The first and second optical sensors 7, 8 output these H-level or L-level signals, respectively, as a first and a second detection signal S1, S2.

Also, as illustrated in FIG. 2, a stopper 32 is disposed between the hammer 5 and string S. The stopper 32, which prevents the hammer 5 from striking the string S in the silent play mode, comprises a body 32*a*, a cushion (not shown) attached to its front surface, and the like. The stopper 32 is pivotably supported on a fulcrum 32*b* at the proximal end of the body 32*a*, and is driven by a motor (not shown). In the normal play mode, the stopper 32 extends in the vertical direction and is driven to a retracted position (indicated by solid lines in FIG. 2) retracted from a range in which the hammer shank 5*b* of the hammer 5 pivotally moves. On the other hand, in the silent play mode, the stopper 32 extends in the depth direction, and driven to an advanced position (indicated by two-dot chain lines in FIG. 2) which falls within the range of pivotal movements of the hammer shank 5*b*. The motor is driven by a driving signal from the CPU 23.

In the foregoing configuration, as the key 4 is touched, the key 4 swings about the balance pin 11 in the clockwise direction in FIG. 2, causing the wippen 13 to pivotally move in the counter-clockwise direction, associated with this swinging motion. The jack 14 moves upward together with the wippen 13, associated with the pivotal movement of the wippen 13, causing the hammer push-up rod 14*a* to push up the bat 5*a* to swing the hammer 5 in the counter-clockwise direction. In the normal play mode, the stopper 32 is positioned at the retracted position, causing the hammer head 5*c* to strike the string S. On the other hand, in the silent play mode, the stopper 32 is positioned at the advanced position, causing the hammer shank 5*b* to come into contact with the stopper 32 immediately before the hammer head 5*c* strikes the string S, thus preventing the hammer head 5*c* from striking the string S. Also, associated with the swinging motion of the hammer 5, the shutter 6 opens and closes the light paths of the first and second optical sensors 7, 8 which responsively generate the first and second detection signals S1, S2.

Figure 6:
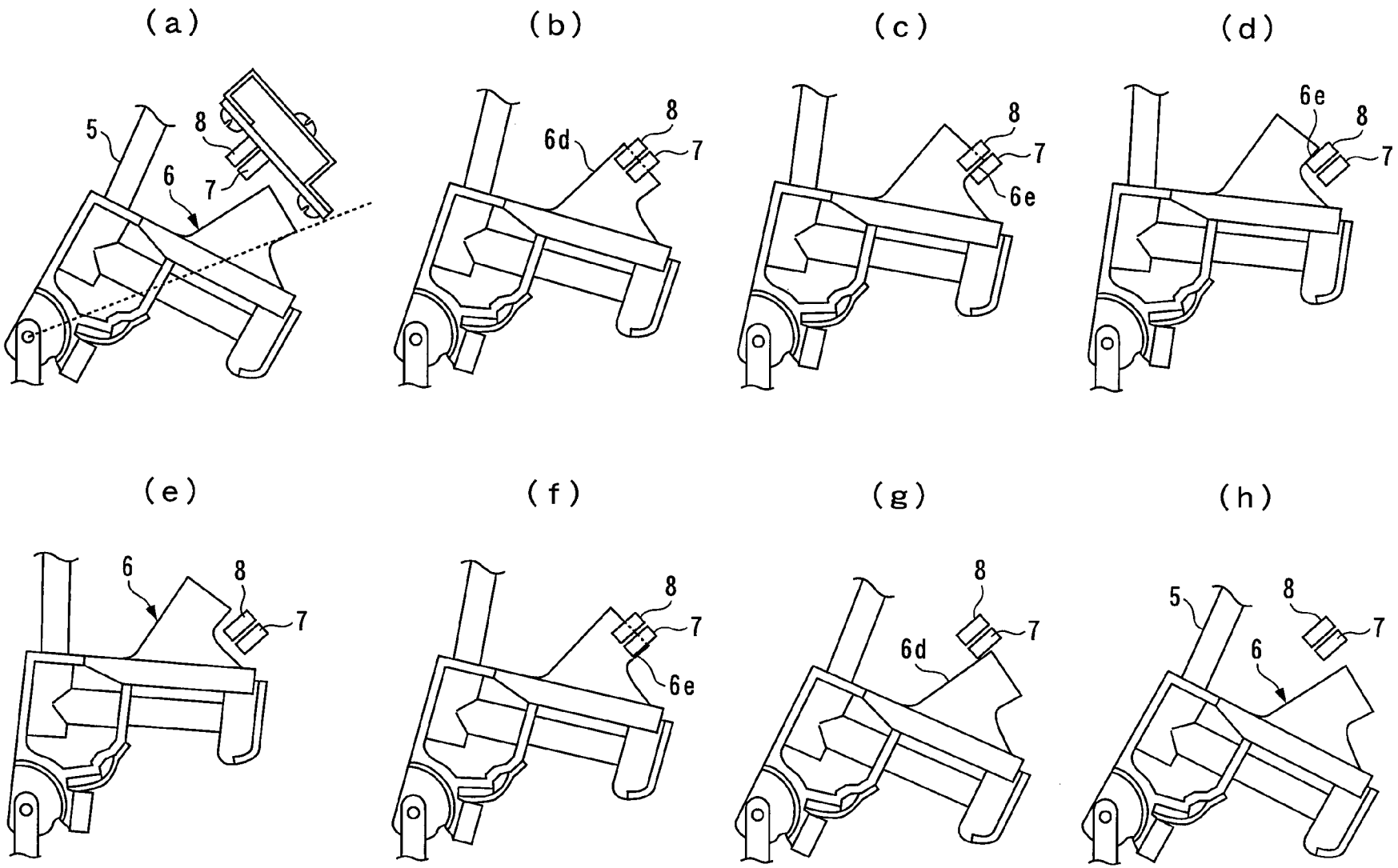
FIG. 6 is a diagram illustrating the position of a hammer in a pivotal movement associated with a key touch.
Figure 7:
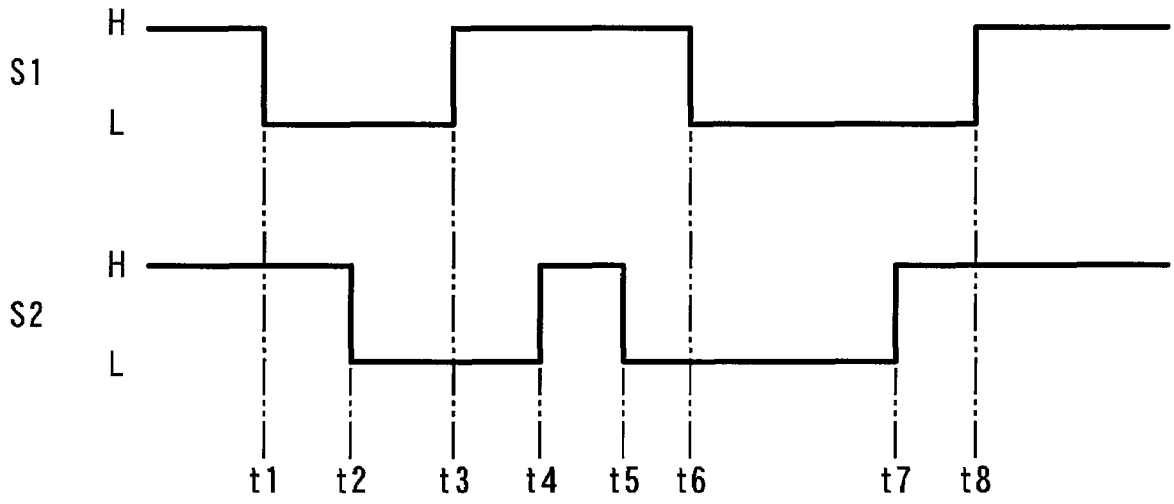
FIG. 7 shows timing charts of a first and a second detection signal during a pivotal movement of the hammer.

FIG. 6 illustrates the position of the hammer 5 in a pivotal movement associated with a key touch, and FIG. 7 shows timing charts of the first and second detection signals S1, S2 during the pivotal movement of the hammer 5. First, in a key released state, the hammer 5 is at a key released position illustrated in FIG. 6(*a*), where the shutter 6 opens the light paths of the first and second sensors 7, 8, causing the same to generate the first and second detection signals S1, S2 both at H level (before timing t1). As the key 4 is touched in this key released state, causing the hammer 5 to swing in the counter-clockwise direction in FIG. 6, the rear edge 6*d* of the shutter 6 reaches the light path of the first optical sensor 7 halfway in the swinging motion of the hammer 5, at which time the light path is intercepted by the shutter 6, causing the first detection signal S1 to go down from H level to L level (t1). As the hammer 5 swings more, the rear edge 6*d* of the shutter 6 reaches the light path of the second optical sensor 8 (FIG. 6(*b*)), causing the second detection signal S2 to go down from H level to L level (t2). As the hammer 5 further swings, the front edge 6*e* of the shutter 6 has passed the first optical sensor 7 (FIG. 6(*c*)) to open the light path thereof, causing the first detection signal S1 to go up from L level to H level (t3). As the hammer 5 further swings, the front edge 6*e* of the shutter 6 has passed the second optical sensor 8, as indicated by two-dot chain lines in FIG. 4, near the position at which the hammer shank 5*b* comes into contact with the stopper 32 (FIG. 6(*d*)), causing the second detection signal S2 to go up from L level to H level (t4).

Subsequently, as the hammer 5 further swings, the hammer shank 5*b* comes into contact with the stopper 32, causing the hammer 5 to start swinging back to the key released position in the clockwise direction in FIG. 6 (FIG. 6(*e*)). When the front edge 6*e* of the shutter 6 reaches the light path of the second optical sensor 8 halfway in the swinging motion back to the key released position, the light path of the second optical sensor 8 is intercepted, causing the second detection signal S2 to go down from H level to L level (t5). As the hammer 5 further swings back to the key released position, the catcher 5*e* comes into contact with the back check 17, and the front edge 6*e* of the shutter 6 reaches the light path of the first optical sensor 7 (FIG. 6(*f*)) near the position at which the hammer 5 stops, to intercept the light path of the first optical sensor 7, causing the first detection signal S1 to go down from H level to L level (t6). As the hammer 5 further swings back to the key released position, the rear edge 6*d* of the shutter 6 has passed the second optical sensor 8, causing the second detection signal S2 to go up from L level to H level (t7). As the hammer 5 further swings back to the key released position, the rear edge 6*d* of the shutter 6 has passed the first optical sensor 7 (FIG. 6(*g*)), as indicated by solid lines in FIG. 4, causing the first detection signal S1 to go up from L level to H level (t8). Subsequently, the hammer 5 returns to the key released position (FIG. 6(*h*)).

Figure 8:
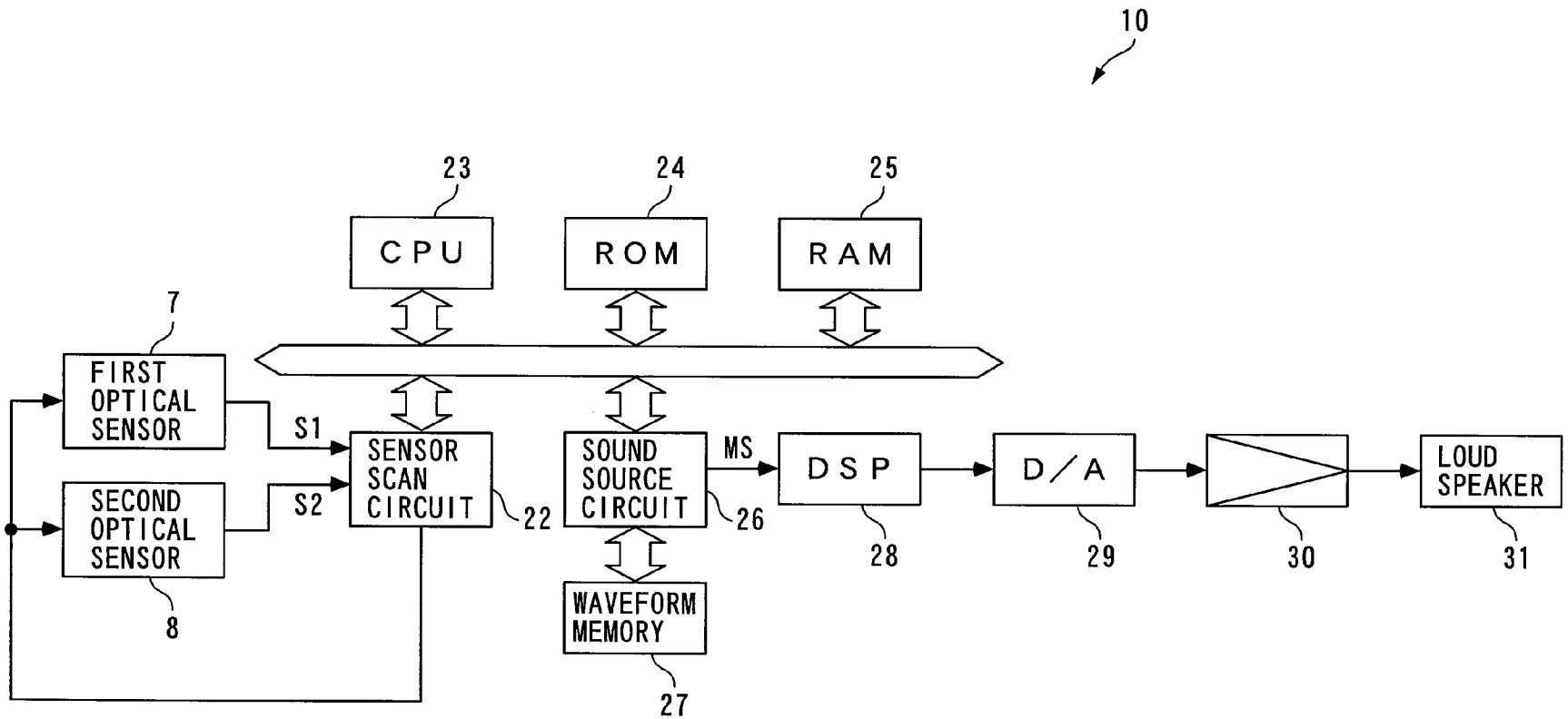
FIG. 8 is a diagram illustrating part of a sound generator.

The sound generator 10 generates sound in the silent play mode, and comprises a sensor scan circuit 22, CPU 23, a ROM 24, a RAM 25, a sound source circuit 26, a waveform memory 27, a DSP 28, a D/A converter 29, a power amplifier 30, a loud speaker 31 and the like, as illustrated in FIG. 8. The sensor scan circuit 22 detects on/off information on the key 4, and key number information for identifying the key 4 which has turned on or off, based on the first and second detection signals S1, S2 outputted from the first and second optical sensors 7, 8, and supplies the CPU 23 with the on/off information and key number information, together with the first and second detection signals S1, S2, as key touch information data on the key 4.

The ROM 24 stores fixed data for controlling the volume and the like, in addition to a control program executed by the CPU 23. The RAM 25, in turn, temporarily stores status information indicative of an operating state in the silent play mode, and the like, and is also used by the CPU 23 as a work area.

The sound source circuit 26 reads sound source waveform data and envelope data from the waveform memory 27 in accordance with a control signal from the CPU 23, and adds the read envelop data to the read sound source waveform data to generate a sound signal MS which serves as source sound. The DSP 28 adds a predetermined sound effect to the sound signal MS generated by the sound source circuit 26. The D/A converter 29 converts the sound signal MS to which the sound effect has been added by the DSP 28 from a digital signal to an analog signal. The power amplifier 30 amplifies the resulting analog signal with a predetermined gain, and the loud speaker 31 reproduces the amplified analog signal for emission as music sound.

The CPU 23 implements sound generation timing setting means, sound stop timing setting means, and sound generation prohibiting means in this embodiment, and controls the operation of the sound generator 10 in the silent play mode. The CPU 23 executes a sound control process for setting a sound generation timing and a sound stop timing in accordance with the first and second detection signals S1, S2 of the first and second optical sensors 7, 8, determining a velocity for controlling the volume in accordance with a speed V at which the hammer 5 swings, and the like.

Figure 9:
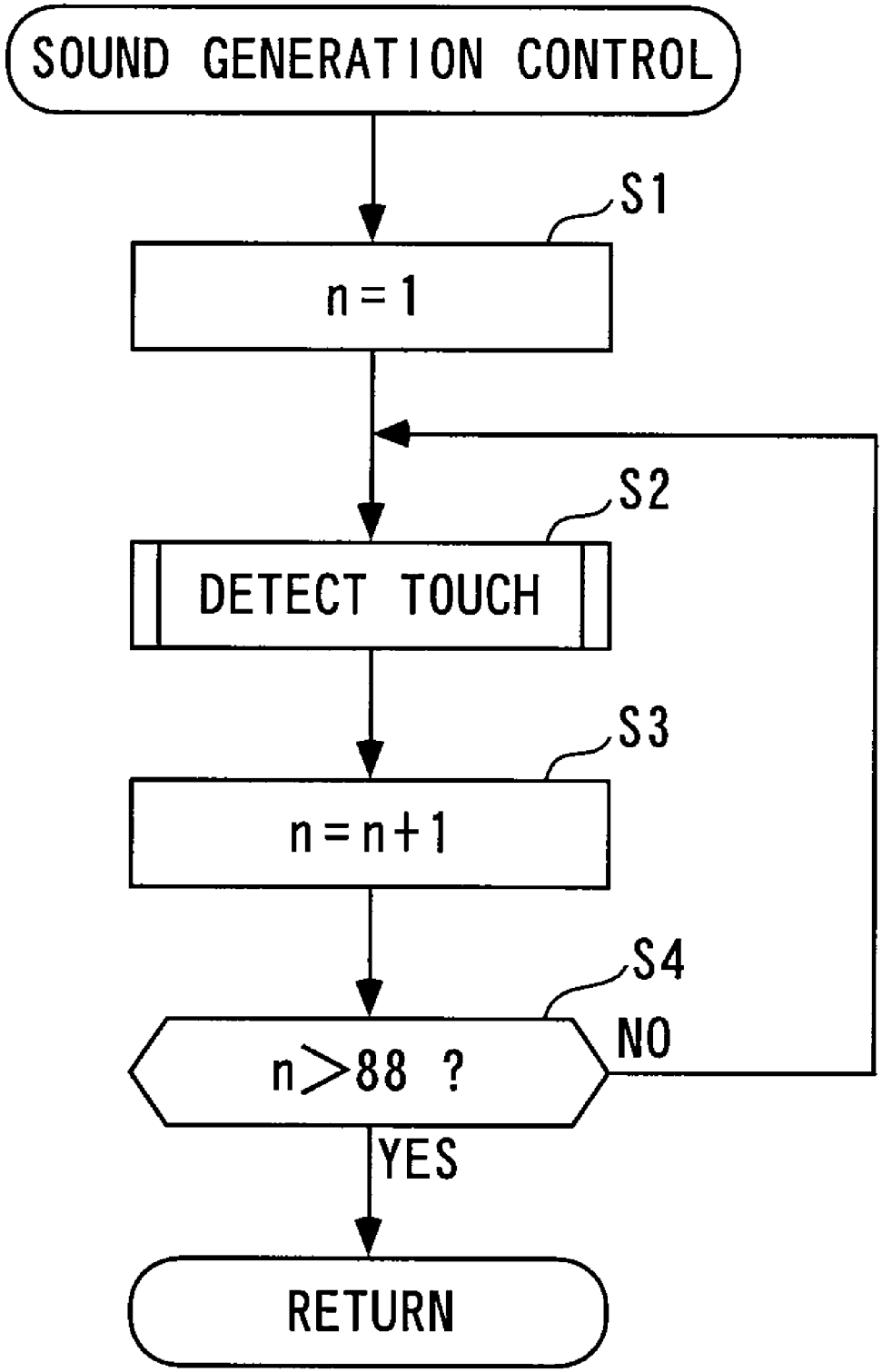
FIG. 9 is a main flow chart illustrating a sound control process executed by a CPU in FIG. 8.

FIG. 9 illustrates a main flow chart of the sound control process. This process is executed sequentially for each of the 88 keys 4. In this process, a key number n (n=1-88) of the key 4 is initialized to one at step 1 ((abbreviated as "S1" in the figures. The same is applied to the following description). Next, touch detection processing is performed, including a sound generation timing, a sound stop timing and the like for the current key number n (step 2).

Next, the key number n is incremented (step 3), and it is determined whether or not the resulting key number n is larger than 88 (step 4). When the result of this determination is NO, the flow returns to step 2, from which the steps are repeated. On the other hand, when the result of the determination at step 4 is YES, i.e., the foregoing process has been completed for all the 88 keys, this process is terminated.

Figure 10:
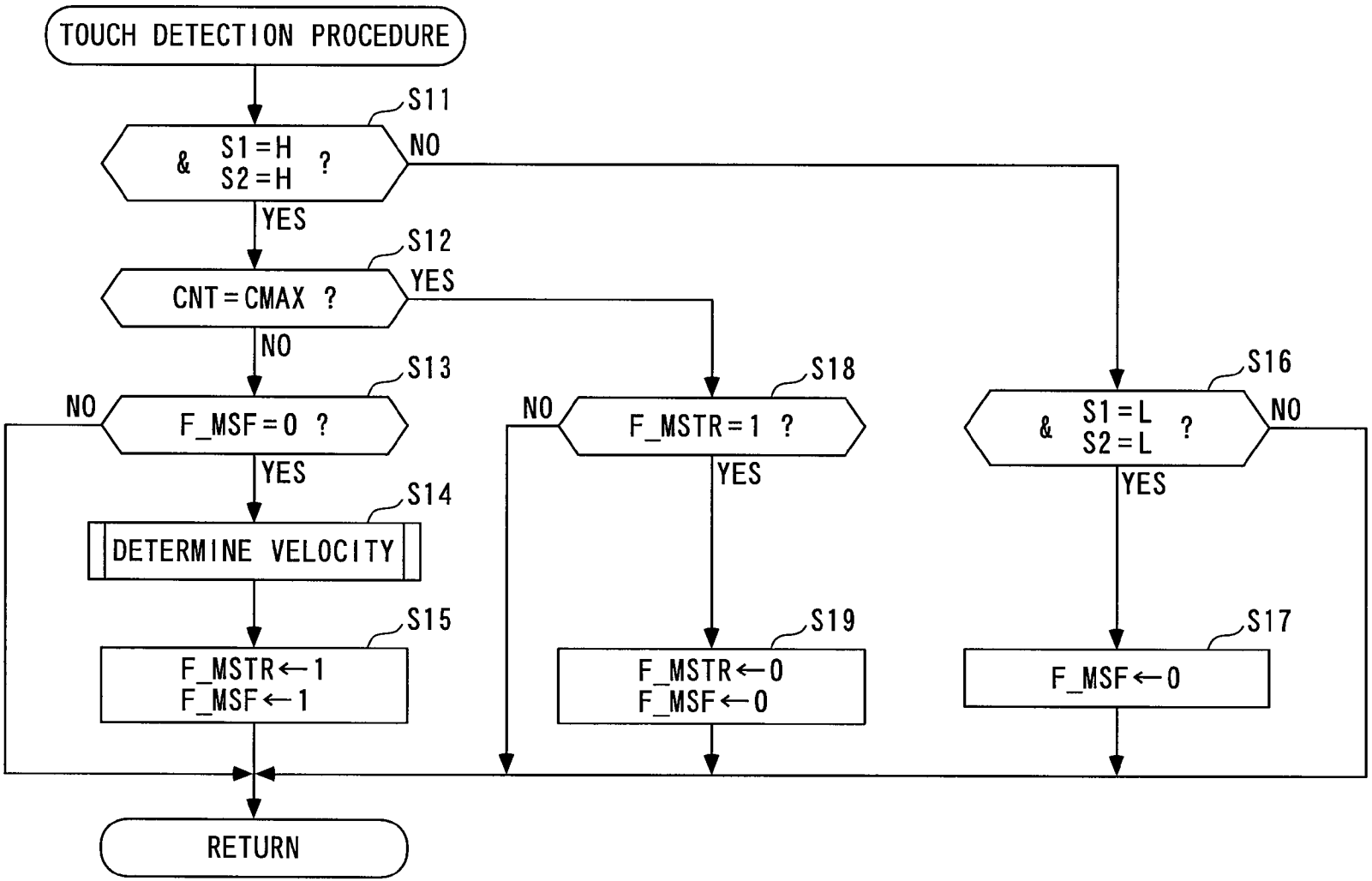
FIG. 10 is a flow chart illustrating a touch detection procedure according to a first embodiment of the present invention.

FIG. 10 is a flow chart illustrating a procedure of the touch detection processing at step 2. In this procedure, it is first determined at step 11 whether or not the first detection signal S1 of the first optical sensor 7 is at H level, and the second detection signal S2 of the second optical sensor 8 is at H level.

When the result of this determination is YES, i.e., the light paths of the first and second sensors 7, 8 are both open, it is determined whether or not value CNT of a counter (not sown) is equal to a maximum value CMAX (step 12).

Figure 11:
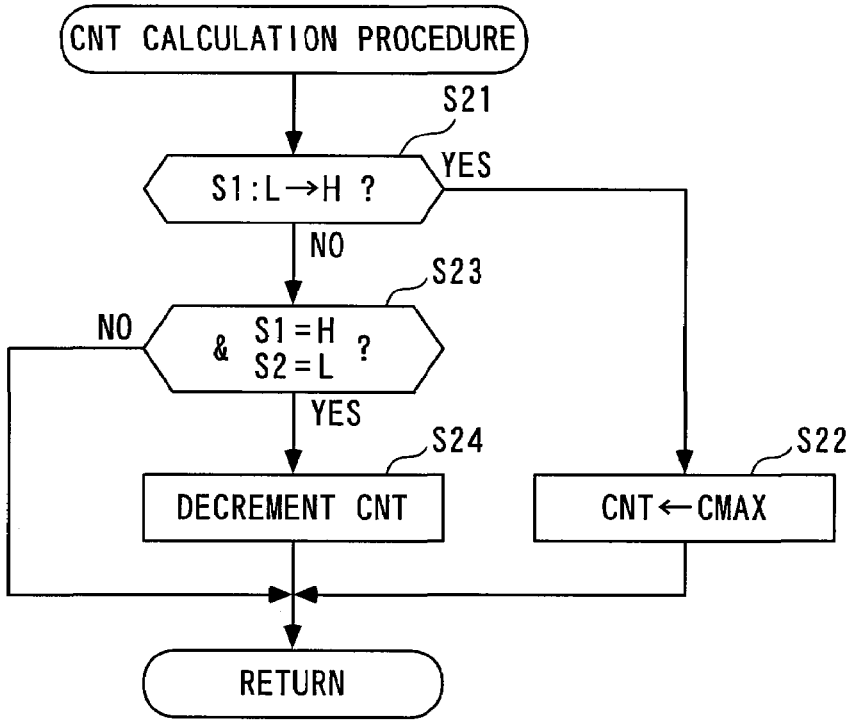
FIG. 11 is a flow chart illustrating a counter value calculation procedure.

The counter value CNT is calculated by a procedure of FIG. 11. In this procedure, it is first determined at step 21 whether or not the first detection signal S1 has changed from L level to H level between the preceding time and current time. When the result of this determination is YES, indicating a timing immediately after the shutter 6 has opened the light path of the first optical sensor 7, the counter value CNT is set to the maximum value CMAX (step 22), followed by the termination of the CNT calculation procedure.

On the other hand, when the result of the determination at step 21 is NO, it is determined whether or not the first detection signal S1 is at H level, and the second detection signal S2 is at L level (step 23). When the result of this determination is YES, indicating that the light path of the first optical sensor 7 is opened, and the light path of the second optical sensor 2 is intercepted, the counter value CNT is decremented (step 24), followed by the termination of the CNT calculation procedure. On the other hand, when the result of the determination at step 23 is NO, the CNT calculation procedure is terminated.

Figure 12:
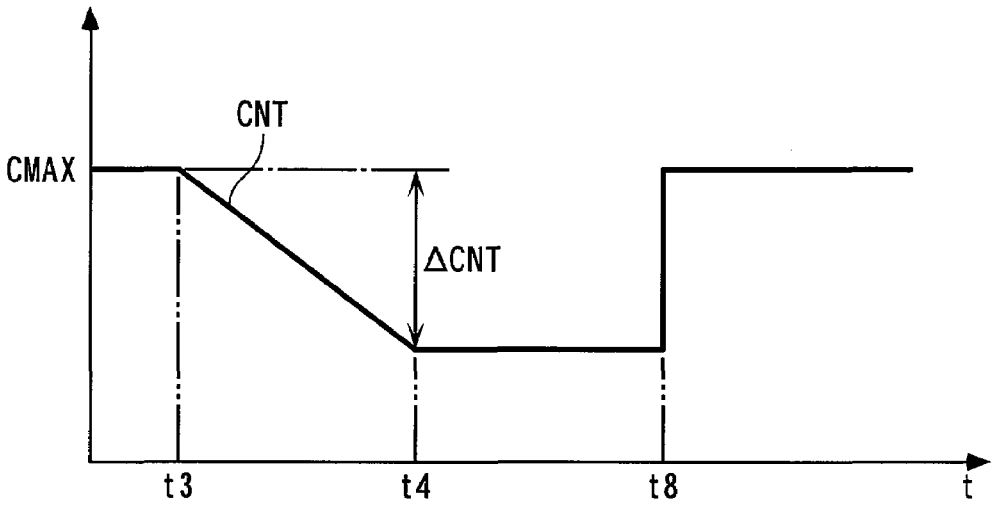
FIG. 12 is a graph showing an exemplary relationship of a counter value to the position of the pivotally moving hammer.

The counter value CNT calculated in the foregoing manner is set to the maximum value CMAX when the front edge 6*e* of the shutter 6 has passed the first optical sensor 7 (t3) when the key 4 is touched, and decremented until the front edge 6*e* has passed the second optical sensor 8 (t4), as illustrated in FIG. 12 as well. The difference (=ΔCNT) between the maximum value CMAX and counter value CNT at t4 is reciprocally proportional to the speed V at which the hammer 5 swings. Subsequently, the counter value CNT is maintained at the value at t4, and set to the maximum value CMAX when the hammer 5 has swung back to the retracted position, so that the rear edge 6*d* of the shutter 6 has passed the first optical sensor 7 (t8). Subsequently, since the result of the determination at step 23 is NO, the counter value CNT is maintained at the maximum value CMAX without being decremented.

Turning back to FIG. 10, when the result of the determination at step 12 is NO, indicating that the counter value CNT is not equal to the maximum value CMAX, i.e., at a timing (FIG. 6(*d*), t4) immediately after the front edge 6*e* of the shutter 6 has passed the second optical sensor 8, associated with the swinging motion of the hammer 5 resulting from a key touch, this timing is determined to be a sound generation timing at which music sound should be generated. Next, it is determined whether or not a re-generation prohibition flag F_MSF is "0" (step 13). This re-generation prohibition flag F_MSF is initialized to "0" when the power supply (not shown) is turned on. Accordingly, the result of the determination at step 13 is YES, in which case the velocity is determined (step 14).

Figure 13:
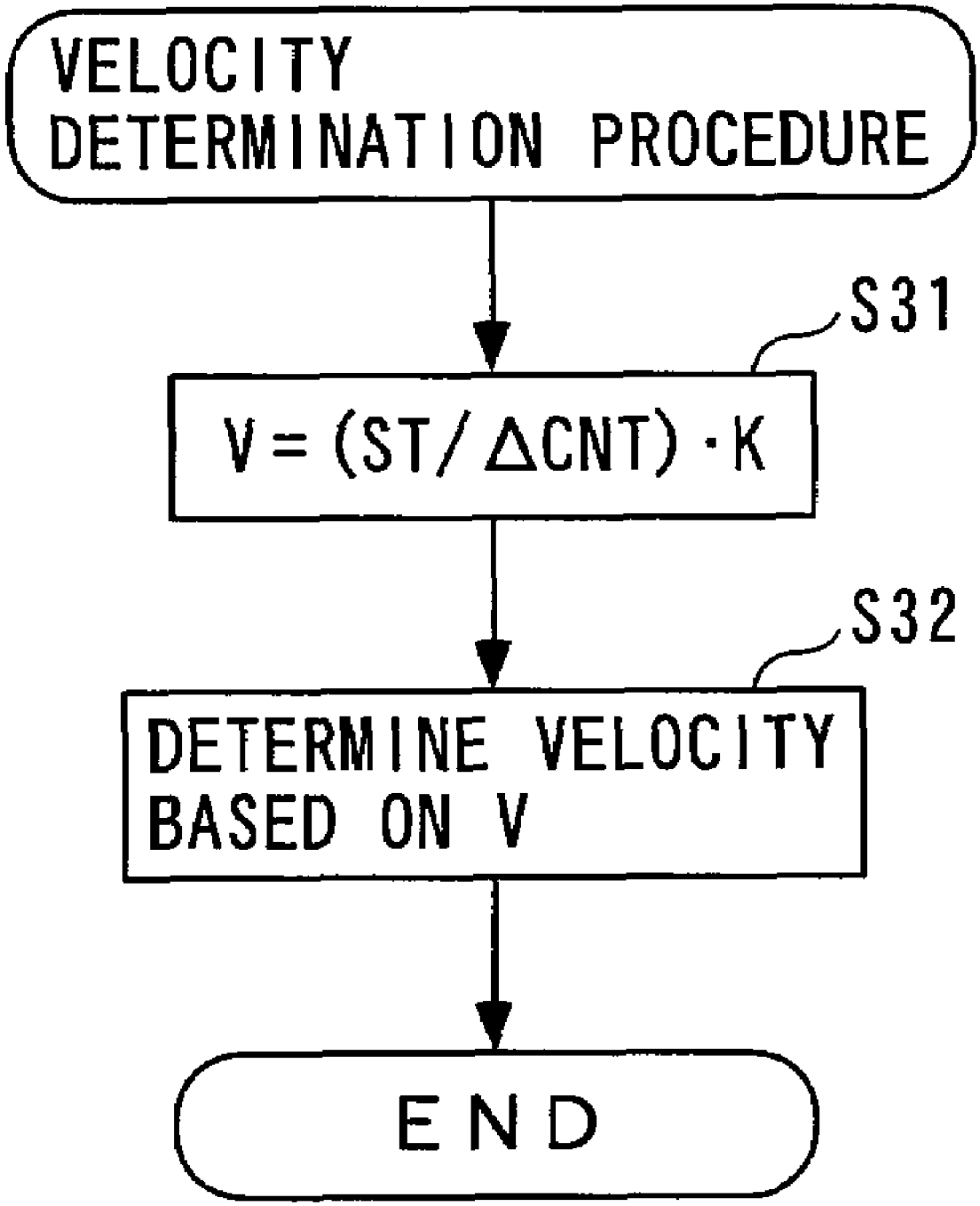
FIG. 13 is a flow chart illustrating a velocity determination procedure.

The velocity is determined by a procedure of FIG. 13. In this procedure, first at step 31, a swing stroke ST between the first and second optical sensors 7, 8 is divided by the difference ΔCNT of the counter value calculated by the procedure of FIG. 11, and the quotient is multiplied by a predetermined coefficient K to calculate the swinging speed V of the hammer 5. Then, the velocity is determined based on the calculated swinging speed V (step 32), followed by the termination of velocity determination procedure.

Turning back to FIG. 10, at step 15 next to step 14, a sound generation execution flag F_MSTR is set to "1." When the sound generation execution flag F_MSTR is set to "1" in this way, a control signal for starting the generation of sound is supplied to the sound source circuit 26 to start generating sound based on the determined velocity and the like. Also, the re-generation prohibition flag F_MSF is set to "1" in order to prohibit music sound from being re-generated, followed by the termination of the touch detection procedure.

By executing step S15, the result of the determination at step 13 is NO, in which case the touch detection procedure is terminated.

On the other hand, when the result of the determination at step 11 is NO, indicating that at least one of the first and second detection signals S1, S2 is at L level, it is determined whether or not both the first and second detection signals S1, S2 are at L level (step 16). When the result of this determination is NO, the touch detection procedure is terminated. On the other hand, when the result of the determination at step 16 is YES, indicating that the light paths of the first and second optical sensors 7, 8 are both intercepted (FIG. 6(*f*)), the re-generation prohibition flag F_MSF is reset to "0" in order to release the prohibition of re-generation (step 17), followed by the termination of the touch detection procedure.

When the result of the determination at step 12 is YES, i.e, at a timing (FIG. 6(*g*), t8) immediately after the rear edge 6*d* of the shutter 6 has passed the first optical sensor 7, associated with a swinging motion of the hammer 5 back to the retracted position, the timing is determined to be a sound stop timing at which music sound should be stopped. It is next determined whether or not the sound generation execution flag F_MSTR is "1" (step 18). When the result of this determination is YES, indicating that sound is being generated, the sound generation execution flag F_MSTR is reset to "0." When the sound generation execution flag F_MSTR is reset to "0" in this way, a control signal for stopping the generation of sound is supplied to the sound source circuit 26 which responsively stops generating sound. Then, the re-generation prohibition flag F_MSF is reset to "0" (step 19), followed by the termination of the touch detection procedure. On the other hand, when the result of the determination at step 18 is NO, the touch detection procedure is terminated.

As described above, according to this embodiment, the front end of the shutter 6 is formed with the cutout 6*c*, so that when the catcher 5*e* come into contact with the back check 17, the cutout 6*c* can prevent the shutter 6 from getting in touch with the back check 17. Thus, the sound generation timing can be appropriately set because of the ability to prevent the hammer 5 from rebounding due to the shutter 6 getting in touch with the back check, and erroneously generated sound caused thereby. Also, by preventing the shutter 6 from getting in touch with the back check 17, it is possible to prevent vibrations associated therewith to maintain a satisfactory touch feeling, as a result.

When the hammer 5 swings associated with a touch on the key 4, the sound generation timing is set making use of the front edge 6*e* of the shutter 6. When the hammer 5 swings back to the retracted position, the sound stop timing is set making use of the rear edge 6*d*. Consequently, since the shutter 6 need not be formed with a shutter window, like the conventional sound control apparatus, the shutter 6 can be correspondingly simplified in shape. In addition, with the omission of the shutter window, the shutter 6 need not be attached such that it closes the light path of the first optical sensor 7 and opens the light path of the second optical sensor 8 in the key released state, unlike the conventional sound control apparatus, so that the shutter 6 can be readily assembled.

The counter value CNT is set to the maximum value CMAX when the first detection signal S1 changes from L level to H level, and is decremented only until the front edge 6*e* of the shutter 6 passes the second optical sensor 8 after it has passed the first optical sensor 7. Thus, when both the first and second detection signals S1, S2 go to H level, and the counter value CNT at that time is not equal to the maximum value CMAX (YES at step 11, No at step 12), the sound generation timing is set on the assumption that the hammer 5 has swung rearward, causing the front edge 6*e* of the shutter 6 to pass the second optical sensor 8. Further, when both the first and second detection signals S1, S2 go to H level, and the counter value CNT is equal to the maximum value CMAX (YES at steps 11 and 12), the sound stop timing is set on the assumption that the hammer 5 has swung back in front, causing the rear edge 6*d* of the shutter 6 to pass the first optical sensor 7. By comparing the counter value CNT with the maximum value CMAX in the foregoing manner, it is possible to correctly identify whether either the front edge 6*e* or rear edge 6*d* of the shutter 6 has passed the first and second optical sensors 7, 8 to appropriately set the sound generation timing and sound stop timing.

Further, after setting the sound generation timing, both the first and second detection signals S1, S2 go to L level to prohibit the setting of a new sound generation timing until the re-generation prohibition flag F_MSF is reset to "0" (steps 13, 16, 17). Thus, even if the hammer 5 swings in the opposite direction halfway during its swinging motion back to the retracted position, or even if the hammer 5 remains at a midway position, a new sound generation timing will not be set unless the front edge 6*e* of the shutter 6 has passed the first and second optical sensors 7, 8 to cause both the first and second detection signals S1, S2 to go to L level, thus making it possible to prevent erroneously generated sound due to such setting. For example, in case where the catcher 5*e* strongly hits the back check 17 halfway in a swinging motion of the hammer 5 back to the retracted position after the front edge 6*e* of the shutter 6 has passed the second optical sensor 8, causing the hammer 5 to rebound, whereby the front edge 6*e* of the shutter 6 passes the second optical sensor 8 to cause a change of the second detection signal S1 from L level to H level, a sound generation timing can be prohibited from being set.

Also, the catcher 5*e* may come into the back check 17 at a different position due to abrasion or the like of back check skin 17*c* over time, causing the front edge 6*e* of the shutter 6 to stay on the light path of the second optical sensor 8 to result in chattering of the second detection signal S2. Even in such an event, erroneously generated sound can be prevented because a new sound generation timing is not set unless both the first and second detection signals S1, S2 go to L level, as described above. Further, since a new sound generation timing can be set when both the first and second detection signals S1, S2 go to L level, the touch repetition performance can be ensured.

Figure 14:
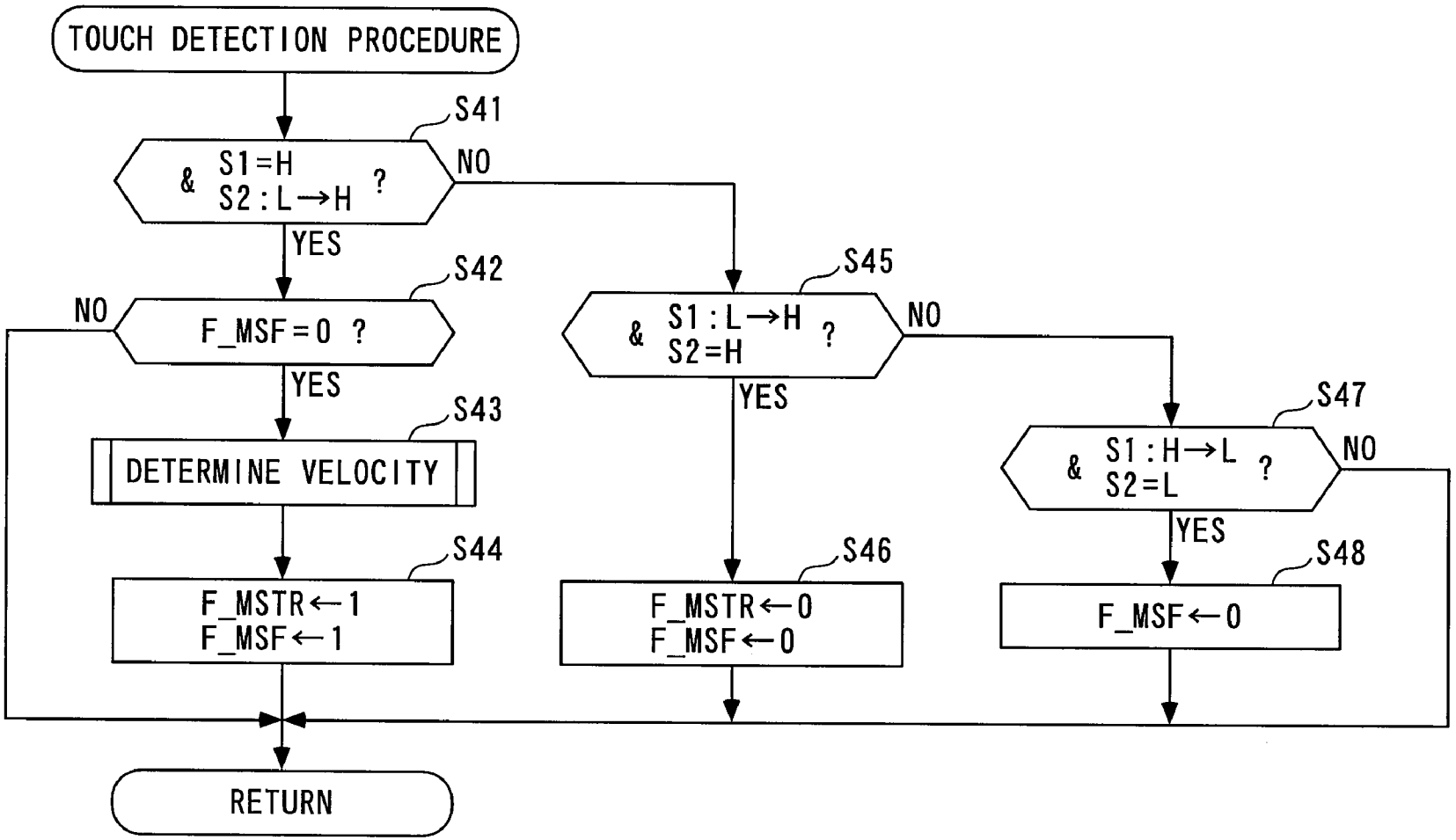
FIG. 14 is a flow chart illustrating a touch detection procedure according to a second embodiment of the present invention.

FIG. 14 is a flow chart illustrating a touch detection procedure according to a second embodiment of the present invention. In this procedure, it is first determined at step 41 whether or not the first detection signal S1 is maintained at H level, and the second detection signal S2 has changed from L level to H level between the preceding time and current time. This determination is comparable to those at steps 11 and 12, as in the first embodiment. When the result of this determination is YES, a timing is determined to be immediately after the front edge 6*e* of the shutter 6 has passed the second optical sensor 8. Subsequent steps 42-44 are the same as steps 13-15 in the first embodiment. Specifically, it is determined whether or not the re-generation prohibition flag F_MSF is "0" (step 42). When the result of the determination is YES, the velocity is determined using the counter value CNT calculated by the procedure of FIG. 11 (step S43), and the sound generation execution flag F_MSTR and re-generation prohibition flag F_MSF are set to "1" (step 44), in a manner similar to the first embodiment, followed by the termination of the touch detection procedure. The execution of step 44 results in NO as determined at step 42, in which case the touch detection procedure is terminated.

On the other hand, when the result of the determination at step 41 is NO, it is determined whether or not the first detection signal S1 has changed from L level to H level, and the second detection signal S2 is maintained at H level between the preceding time and current time (step 45). This determination is comparable to step 18 in the first embodiment.

When the result of the determination is NO, it is determined whether or not the first detection signal S1 has changed from H level to L level, and the second detection signal S2 is maintained at L level between the preceding time and current time (step 47). This determination is comparable to step 16 in the first embodiment. When the result of this determination is NO, the touch detection procedure is terminated.

On the other hand, when the result of the determination at step 47 is YES, indicating that the light path of the first optical sensor 7 has just been intercepted (FIG. 6(*f*)) in addition to the intercepted optical path of the second optical sensor 8, the re-generation prohibition flag F_MSF is reset to "0" in a manner similar to the first embodiment (step 48), followed by the termination of the touch detection procedure.

When the result of the determination at step 45 is YES, it is determined that the rear edge 6*d* of the shutter 6 has just passed the first optical sensor 7. Next, in a manner similar to step 19 in the first embodiment, the sound generation execution flag F_MSTR and re-generation prohibition flag F_MSF are rest to "0" (step 46), followed by the termination of the touch detection procedure.

As described above, according to this embodiment, when the second detection signal S2 has changed from L level to H level (YES at step 41) with the first detection signal S1 maintained at H level between the preceding time and current time, a sound generation timing is determined on the assumption that the front edge 6*e* of the shutter 6 has passed the second optical sensor 8. Also, when the first detection signal S1 has changed from L level to H level (YES at step 45) with the second detection signal S2 maintained at H level, a sound stop timing is set on the assumption that the rear edge 6*d* of the shutter 6 has passed the first optical sensor 7. In the foregoing manner, in the second embodiment, it is possible to identify which of the front edge 6*e* and rear edge 6*d* of the shutter 6 has passed, by determining which of the first and second detection signals S1, S2 has changed, when both the first and second detection signals S1, S2 have gone to H level, without using the counter value CNT. Consequently, the sound generation timing and sound stop timing can be appropriately set as is the case with the first embodiment.

Also, when the shutter 6 intercepts the first optical sensor 7 while it is intercepting the second optical sensor 8 (YES at step 47), the re-generation prohibition flag F_MSF is reset to "0," so that erroneously generated sound can be prevented even if the hammer 5 swings in the opposite direction halfway during a swinging motion thereof back to the retracted position, or even if the hammer 5 stays at an intermediate position, as is the case with the first embodiment.

It should be understood that the present invention is not limited to the embodiments described above, but can be practiced in various manners. For example, in the foregoing embodiments, two optical sensors are provided near the path along which the shutter 6 swings, the number of the optical sensors is not so limited, but can be increased.

Also, the optical sensors used in the foregoing embodiments are photo-interrupters each comprised of a light emitting diode and a photo-transistor, any appropriate type of optical sensor may be used instead. For example, the light emitter may comprise a laser diode or the like, while the light receiver may comprise a photo-diode or the like. Further, while the foregoing embodiments have shown the light emitting diodes and photo-transistors directly placed in a case, light emitting elements and light receiving elements may be connected to optical fibers which are extended to and arranged in the case such that they oppose each other on the light emitting side and light receiving side of the case. In addition, the sound control process is executed by the CPU 23 in the foregoing embodiments, but may instead be executed by the sensor scan circuit 22.

Further, while the foregoing embodiments have shown examples in which the present invention is applied to an upright silent piano, the present invention is not so limited but can also applied to a grand silent piano, further to other types of keyboard-based musical instruments such as an automatic play plano, an electronic piano and the like. Otherwise, details can be modified as appropriate within the scope of the present invention.

What is claimed is:

1. A sound control apparatus for a keyboard-based musical instrument comprising:

a swingable key a hammer having a hammer shank and a catcher, and adapted to swing associated with a swinging motion of said key;

a plate-shaped shutter integrated with said hammer and disposed between said hammer shank and said catcher, extending along a plane including a swinging path along which said hammer swings, and formed with a cutout in an edge on an opposite side to a direction in which said hammer swings associated with a touch on said key;

an optical sensor having a light emitter disposed on one side of the swinging path of said shutter for emitting light, and a light receiver disposed on the other side of the swinging path for receiving the light from said light emitter, for generating a detection signal in accordance with a light receiving state of said light receiver; and sound generation timing setting means for setting a sound generation timing at which music sound should be generated based on the detection signal of said optical sensor responsive to opening and closing of a light path of the light from said light emitter of said optical sensor by said shutter, when said hammer swings.

2. A sound control apparatus for a keyboard-based musical instrument according to claim 1, further comprising:

sound stop timing setting means for setting a sound stop timing at which the music sound should be stopped based on the detection signal of said optical sensor, wherein said sound generation timing setting means sets the sound generation timing based on a timing at which the detection signal changes from a closed state to an opened state in response to said optical sensor being passed by the edge formed with the cutout of said shutter, and said sound stop timing setting means sets the sound stop timing based on a timing at which the detection signal changes from a closed state to an opened state in response to said optical sensor being passed by the edge of said shutter opposite to the edge formed with the cutout.

3. A sound control apparatus for a keyboard-based musical instrument according to claim 2, wherein:

said optical sensor comprises a plurality of optical sensors disposed along the swinging path, and said sound control apparatus further comprises sound generation prohibiting means for prohibiting said sound generation timing setting means from setting a new sound generation timing until all detection signals of said plurality of optical sensors change to a closed state after setting the sound generation timing.

4. A sound control apparatus for a keyboard-based musical instrument according to claim 1, wherein:

said shutter is attached to said catcher.

* * * * *